US009855480B2

(12) United States Patent
Kalogiros et al.

(10) Patent No.: US 9,855,480 B2
(45) Date of Patent: Jan. 2, 2018

(54) BICYCLE TRAINER

(71) Applicant: SBI Media Holding SA, Delemont, Jura (CH)

(72) Inventors: James Kalogiros, Jura (CH); Fadi Yassmin, Jura (CH); Peter Berlowitz, Jura (CH)

(73) Assignee: SBI Media Holding SA, Jura (CH)

( * ) Notice: Subject to any disclaimer, the term of this patent is extended or adjusted under 35 U.S.C. 154(b) by 0 days.

(21) Appl. No.: 15/025,465

(22) PCT Filed: Sep. 27, 2013

(86) PCT No.: PCT/EP2013/070218

§ 371 (c)(1),
(2) Date: Mar. 28, 2016

(87) PCT Pub. No.: WO2015/043656

PCT Pub. Date: Apr. 2, 2015

(65) Prior Publication Data

US 2016/0236055 A1 Aug. 18, 2016

(51) Int. Cl.
*A63B 21/00* (2006.01)
*A63B 21/005* (2006.01)
(Continued)

(52) U.S. Cl.
CPC ..... *A63B 69/16* (2013.01); *A63B 21/0058* (2013.01); *A63B 21/00178* (2013.01);
(Continued)

(58) Field of Classification Search
CPC ..... A63B 21/00058; A63B 21/00069; A63B 21/00072; A63B 21/00076; A63B 21/00178; A63B 21/00181; A63B 21/00185; A63B 21/002; A63B 21/0023; A63B 21/005; A63B 21/0058; A63B 21/008; A63B 21/0083; A63B 21/0085; A63B 21/0087; A63B 21/02;
(Continued)

(56) References Cited

U.S. PATENT DOCUMENTS 554,754 A * 2/1896 Webber ..... A63B 69/16 482/61
2,287,084 A * 6/1942 Bennett ..... G01L 3/20 73/116.09

(Continued)

FOREIGN PATENT DOCUMENTS

BE 1003439 A6 3/1992
EP 1 214 957 6/2002

(Continued)

*Primary Examiner* — Andrew S Lo
*Assistant Examiner* — Gary D Urbiel Goldner
(74) *Attorney, Agent, or Firm* — Norris McLaughlin & Marcus P.A.

(57) ABSTRACT

A bicycle trainer includes a support for supporting a bicycle having a frame and a rear wheel attached to a rear axle, the support biasing the bicycle into an upright orientation, and a roller for engaging with the rear wheel of the bicycle, wherein, when the bicycle is supported by the support, the roller is adapted to provide resistance against turning the rear wheel and the rear axle of the bicycle is not connected to the support.

20 Claims, 8 Drawing Sheets

(51) Int. Cl.

| | |
|---|---|
| ***A63B 21/02*** | (2006.01) |
| ***A63B 22/06*** | (2006.01) |
| ***A63B 69/16*** | (2006.01) |
| ***A63B 71/00*** | (2006.01) |
| ***A63B 71/02*** | (2006.01) |
| ***A63B 71/06*** | (2006.01) |
| *A63B 24/00* | (2006.01) |

(52) U.S. Cl.
CPC ..... *A63B 21/023* (2013.01); *A63B 24/0087* (2013.01); *A63B 71/0619* (2013.01); *A63B 2022/0641* (2013.01); *A63B 2069/163* (2013.01); *A63B 2069/164* (2013.01); *A63B 2069/166* (2013.01); *A63B 2069/167* (2013.01); *A63B 2069/168* (2013.01); *A63B 2071/0072* (2013.01); *A63B 2071/025* (2013.01); *A63B 2225/09* (2013.01)

(58) Field of Classification Search
CPC ... A63B 21/023; A63B 21/025; A63B 21/028; A63B 21/04; A63B 21/0407; A63B 21/0414; A63B 21/0428; A63B 21/0435; A63B 21/0442; A63B 21/045; A63B 21/0455; A63B 21/05; A63B 21/068; A63B 21/08; A63B 21/15; A63B 21/159; A63B 21/16; A63B 21/22; A63B 21/4027; A63B 21/4045; A63B 21/4047; A63B 21/4049; A63B 22/0015; A63B 22/0017; A63B 22/0023; A63B 22/0046; A63B 22/06; A63B 22/0605; A63B 22/18; A63B 22/20; A63B 22/201; A63B 22/203; A63B 2022/635; A63B 2022/0641; A63B 23/0305; A63B 23/03516; A63B 23/03533; A63B 23/03541; A63B 23/04; A63B 23/0405; A63B 23/0423; A63B 23/0476; A63B 23/0482; A63B 23/0494; A63B 24/0087; A63B 26/00; A63B 26/003; A63B 69/16; A63B 2069/161; A63B 2069/162; A63B 2069/163; A63B 2069/164; A63B 2069/165; A63B 2069/166; A63B 2069/167; A63B 2069/168; A63B 71/0054; A63B 2071/0063; A63B 2071/0072; A63B 2071/0081; A63B 2071/009; A63B 2071/025; A63B 2208/0228; A63B 2208/0233; A63B 2225/09; A63B 2225/093; A63B 2225/096

See application file for complete search history.

(56) References Cited

U.S. PATENT DOCUMENTS

| | | | | | |
|---|---|---|---|---|---|
| 2,498,047 | A * | 2/1950 | Myers | A63B 69/16 | 482/61 |
| 2,504,007 | A * | 4/1950 | Declercq | A63B 24/0084 | 273/441 |
| 2,803,349 | A * | 8/1957 | Talbot | B62H 3/00 | 211/22 |
| 3,076,650 | A * | 2/1963 | Richter | A63B 69/16 | 211/22 |
| 4,021,034 | A * | 5/1977 | Olesen | A63B 69/16 | 211/22 |
| 4,082,265 | A | 4/1978 | Berkes | | |
| 4,415,152 | A * | 11/1983 | Smith | A63B 22/16 | 434/247 |
| 4,648,597 | A * | 3/1987 | Adler | A63B 69/16 | 280/296 |
| 4,802,666 | A * | 2/1989 | Rodriqguez | A63B 69/16 | 280/293 |
| 4,887,967 | A * | 12/1989 | Letovsky | G09B 9/058 | 434/61 |
| 4,932,651 | A * | 6/1990 | Defaux | A63B 69/16 | 434/61 |
| 5,010,763 | A * | 4/1991 | Schneider | G01M 17/0076 | 73/116.09 |
| 5,083,772 | A * | 1/1992 | Brown | A63B 24/00 | 482/59 |
| 5,240,417 | A * | 8/1993 | Smithson | A63B 21/00181 | 348/121 |
| 5,662,559 | A | 9/1997 | Vasquez | | |
| 6,056,672 | A * | 5/2000 | Carbonell Tendero | A63B 22/16 | 434/61 |
| 6,505,503 | B1 * | 1/2003 | Teresi | G09B 9/058 | 340/466 |
| 6,857,992 | B1 * | 2/2005 | Kolda | A63B 21/0051 | 482/61 |
| 7,736,282 | B1 * | 6/2010 | Horowitz | A63B 69/16 | 482/57 |
| 7,870,809 | B2 * | 1/2011 | Rice | A63B 22/0012 | 74/551.1 |
| 7,927,258 | B2 * | 4/2011 | Irving | A63B 21/015 | 482/51 |
| 8,092,352 | B2 * | 1/2012 | Irving | A63B 21/225 | 482/57 |
| 8,202,201 | B2 * | 6/2012 | Baheti | A63B 22/02 | 482/8 |
| 9,486,667 | B2 * | 11/2016 | Kimura | A63B 69/16 | |
| 2005/0008992 | A1 * | 1/2005 | Westergaard | A63B 22/16 | 434/61 |
| 2005/0209064 | A1 | 9/2005 | Peterson et al. | | |
| 2007/0010377 | A1 * | 1/2007 | Wu | A63B 69/16 | 482/61 |
| 2007/0060453 | A1 * | 3/2007 | Papadopoulos | A63B 69/16 | 482/61 |
| 2009/0075785 | A1 | 3/2009 | Schroeder | | |
| 2011/0039664 | A1 * | 2/2011 | Cooper | A63B 24/0087 | 482/61 |
| 2011/0136630 | A1 * | 6/2011 | Zwinkels | A63B 69/16 | 482/61 |
| 2011/0218080 | A1 * | 9/2011 | Papadopoulos | A63B 69/16 | 482/61 |
| 2014/0296038 | A1 * | 10/2014 | Colan | A63B 69/16 | 482/61 |
| 2016/0082310 | A1 * | 3/2016 | Colan | A63B 69/16 | 482/63 |
| 2016/0158620 | A1 * | 6/2016 | Bauer | A63B 69/16 | 482/61 |

FOREIGN PATENT DOCUMENTS

| | | |
|---|---|---|
| EP | 1 683 550 | 7/2006 |
| JP | S43-13544 U | 6/1968 |
| JP | S61-188775 U | 11/1986 |
| WO | WO-91/08024 | 6/1991 |
| WO | 2007/083341 A1 | 7/2007 |

* cited by examiner

BICYCLE TRAINER

BACKGROUND OF THE INVENTION

The present invention relates to an improved bicycle trainer.

In general, two different kinds of bicycle trainers are known and commonly used. A first type of trainer (also called turbo trainer) is a piece of equipment that makes it possible to ride a bicycle while it remains stationary. Such a trainer typically comprises a frame, a clamp to hold the bicycle securely, a roller that presses up against the rear wheel of the bicycle, and a mechanism that provides resistance when the pedals are turned. These trainers are categorized by how the unit provides resistance into wind trainers, magnetic trainers, fluid trainers, centrifugal trainers and utilitarian trainers. In all these trainers of the first type, the bicycle is fixedly mounted onto the trainer and remains entirely stationary during training. Typically, the trainer is fixedly mounted to the rear axle of the bicycle. An entirely different type of bicycle trainers are the so-called bicycle rollers which, unlike other types of bicycle trainers, do not attach to the bicycle frame. These bicycle rollers normally comprise three cylinders, drums or rollers, two for the rear wheel and one for the front wheel, on top of which the bicycle rides. A belt may connect one of the rear rollers to the front roller causing the front wheel of the bicycle to spin when the bicycle is pedaled. The rider must balance him- or herself on the rollers while training.

Each type of bicycle trainer has certain advantages and disadvantages. Riding on a stationary bicycle trainer does never provide a feeling like riding a bicycle in reality, because the bicycle remains entirely stationary. However, during riding a bicycle in reality the pedaling motion is usually compensated by slightly tilting the bicycle with respect to the vertical, in particular during sprinting. While bicycle rollers do allow for such tilting movements balancing the bicycle without riding off the rollers is quite a challenge for the rider and requires much more balance and attention than bicycle trainers.

US 2009/0075785 A1 describes a further type of bicycle trainer which is adapted for use with a bicycle. The trainer includes a base and a frame having spaced apart ends adapted to engage and support the bicycle. A pivoting assembly is joined to a central portion of the frame and to the base. The pivoting assembly allows movement between the frame and the base and includes a biasing mechanism that resists tilting of the frame relative to the base. The frame is supported only by the pivoting assembly. The frame of said bicycle trainer is mounted to the rear axle of the bicycle by means of couplers.

Said mounting of the rear axle to the bicycle trainer is disadvantageous, because the biasing force that resists tilting of the frame relative to the base is transferred to the bicycle via the rear wheel which, during real cycling conditions, is free to move. Moreover, because a substantial portion of the weight of the bicycle and the driver is carried by the frame (via the couplers) rather than by a roller, the tilting movement of the bicycle on said bicycle trainer feels less natural than riding a bike on the road. In particular, as the roller is not directly bearing the weight of the bicycle and the user the tire of the real wheel may slip during acceleration and thus one may not generate the same power output as one can achieve on the road.

SUMMARY OF THE INVENTION

It is an object of the present invention to provide an improved bicycle trainer which combines the advantages of stationary bicycle trainers and bicycle rollers and which overcomes the disadvantages of the bicycle trainer known from US 2009/0075785 A1. It is, in particular, an object of the present invention to provide a bicycle trainer which simulates the conditions of cycling on the road as closely as possible. This object is achieved with a bicycle trainer according to claim 1. Preferred embodiments are described in the dependent claims.

The present invention relates to a bicycle trainer comprising a support for supporting a bicycle having a frame and a rear wheel attached to a rear axle. The support comprises means for biasing the bicycle into an upright orientation. The bicycle trainer further comprises a roller for engaging with the rear wheel of the bicycle. When the bicycle is supported by the support, the roller is adapted to provide resistance against turning the rear wheel. The rear axle of the bicycle is not directly connected or mounted to the support of the bicycle trainer. In other words, the rear axle and the rear wheel of the bicycle are, to a certain extent, free to move. Preferably, the rear wheel of the bicycle is free to move in a lateral direction on the roller when the bicycle is supported by the support. In addition or alternatively, the support preferably allows for lifting the rear wheel off the roller, when the bicycle is supported by the support.

It has turned out that mounting the bicycle frame with a portion other than the rear axle to the support of the bicycle trainer substantially improves the natural feeling provided during training on the inventive bicycle trainer. Simulating a real life situation is on the one hand substantially improved by allowing lateral and/or vertical movement of the rear axle/rear wheel. On the other hand, transmitting any biasing force that resists tilting of the frame via the rear axle feels unnatural, because the force is introduced at the rear end of the bicycle frame, whereas during cycling on the road these biasing forces are provided by inertia and/or torques created by pedaling. These forces are typically introduced into the bicycle frame at a rather central portion of the frame. It is therefore particularly preferred to mount the bicycle frame to the support at a position of the bicycle frame between the front axle and the rear axle, preferably in a central region between the front axle and the rear axle. According to a preferred embodiment, the support of the bicycle trainer supports the bicycle at the down tube and/or at the bottom bracket of the bicycle frame. By contrast, the bicycle trainer known from, e.g., US 2009/0075785 A1 has a pivot point at the very back of the bicycle frame and close to the bottom, namely at the rear axle. Thus, the torques generated during pedaling are quite unnatural and may even lead to a situation where pushing down the right-side pedal causes the bicycle frame to also pivot to the right side—which is exactly the opposite as during a real life situation on the road. As the bicycle trainer of the present invention allows the entire bicycle frame to essentially freely move (as on the road) the torques are introduced into the frame quite similarly to a real life situation which causes the frame to pivot correctly.

Preferably, the bicycle is supported by the support in such a manner that, during use, at least 80%, preferably at least 90% and more preferably at least 95% of the weight of the bicycle (and the user) is carried by the front wheel and the rear wheel. This should at least be the case as long as the bicycle is oriented in an upright orientation. If the bicycle is tilted, the means of biasing the bicycle into an upright orientation evidently also carries a small portion of the weight. Preferably, the rear wheel of the bicycle is supported by the roller, when the bicycle is mounted to the support. In other words, it is preferred that the rear wheel rests or sits on the roller and that the weight resting on the rear axle is completely carried by the roller. If two rollers are provided for the rear wheel, the entire weight resting on the rear axle is carried by these two rollers. This is particularly advantageous, because the rider gets the impression to really ride on a road as the entire force transmission from rear axle to roller is quite similar to that from the rear axle to a road. Moreover, due to the direct weight bearing on the one or two rollers the same power output as on the road may be generated because said design effectively avoids any slippage of the tire on the roller.

The means for biasing is preferably adapted to allow for a tilting movement of the bicycle. Preferably, the means for biasing is adapted to provide a torque biasing the bicycle into an upright orientation of the bicycle beyond a predetermined first critical angle versus the vertical. The first critical angle is preferably smaller than 1°, more preferably smaller than 0.5° and most preferably about 0°. According to a first preferred embodiment, no biasing torque is provided up to said first critical angle, whereas at and beyond said critical angle the biasing means provides a torque biasing the bicycle into an upright orientation. According to a second preferred embodiment (corresponding to the first critical angle being about 0°), the means for biasing always provides a torque biasing the bicycle into an upright orientation.

It is further preferred that the bicycle trainer comprises a stop adapted to avoid a tilting movement of the bicycle beyond a predetermined second critical angle versus the vertical. The second critical angle preferably lies in a range between 2° and 6°, more preferably between 3° and 5° and most preferably is about 4°. In a particularly preferred embodiment, a constant force or torque biasing the bicycle into an upright orientation is provided over the entire from −4° to +4°.

Preferably, the means for biasing is adapted to be, directly or indirectly, connected to the bicycle frame at a portion other than the rear axle, more preferably to the down tube and/or bottom bracket of the bicycle frame. The connection of the bicycle frame to the biasing means is preferably releasable and can preferably be adapted to different types and sizes of bicycles.

The means for biasing preferably further comprises two independent springs. The springs are preferably adapted to provide a torque biasing the bicycle into an upright orientation. The amount of the torque can preferably be adjusted by means of a motor. Alternatively, it may also be possible to adjust the torque manually. It is preferred that the torque can be adjusted by changing the lever arm acting on the springs. Preferably, the torque can be adjusted in a range between about 5 Nm and about 200 Nm, more preferably between about 15 Nm and about 150 Nm and even more preferably between about 25 Nm and about 100 Nm. Alternatively, it may be possible to adjust the spring force of the springs.

The bicycle trainer preferably further comprises a motor adapted to adjust the resistance against turning the rear wheel. The resistance is preferably actively provided by the motor itself. Preferably, the motor is provided within the roller. It is further preferred that the motor is also adapted to actively provide a driving force to the rear wheel.

Preferably, two rollers are provided for the rear wheel wherein one roller is adapted to actively transmit a driving force and/or a breaking force to the rear wheel, whereas the second roller may rotate without providing any substantial resistance. Providing two rollers further improves the "real road feeling" as the tire is better supported on two rollers than with a single contact point (of two convex curves).

Preferably, the support for supporting the bicycle comprises a front portion for mounting the front wheel of the bicycle. Preferably, the front wheel is mounted stationary, i.e., the front wheel cannot be turned. The distance between the mounting for the front wheel and the roller(s) for the rear wheel can preferably be adjusted in order to adapt the bicycle trainer to different types and sizes of bicycles. Moreover, the mounting for the front wheel can preferably be adjusted to wheels/tires having different widths.

The means for biasing the bicycle into an upright orientation preferably comprises a system of posts or rods for attaching to the down tube of the bicycle. Preferably, said system comprises a cylinder and a piston which can move up and down within said cylinder. This allows for mounting the bicycle to the support without transmitting any substantial force along the vertical direction. In other words, the bicycle, once mounted, may be moved up and down by simply overcoming the resistance between piston and cylinder. The system of rods or posts preferably further comprises an additional rod being pivotably attached to the piston. This allows to adjust for different orientations of the down tube of different types and sizes of bikes.

The bicycle trainer preferably further comprises an additional motor for adjusting the lever arm of the means for biasing the bicycle into an upright orientation. Preferably, changing the lever arm does not change the extension or compression of the springs, but only changes the lever arm acting on the springs. Preferably, tilting the bicycle in one direction only compresses one of the two springs, but does not extend the other of the two springs.

The bicycle trainer of the present invention is superior to known bicycle trainers, because it is adapted to simulate real road conditions exceptionally well. Moreover, the bicycle trainer of the present invention is very versatile in that it can accommodate basically any type and size of bicycle by simply adjusting a few parts of the bicycle trainer. Further advantages of the bicycle trainer of the present invention will be evident from the description of the detailed embodiments with reference to the following Figures, which show:

DETAILED DESCRIPTION OF THE INVENTION

Figure 1:
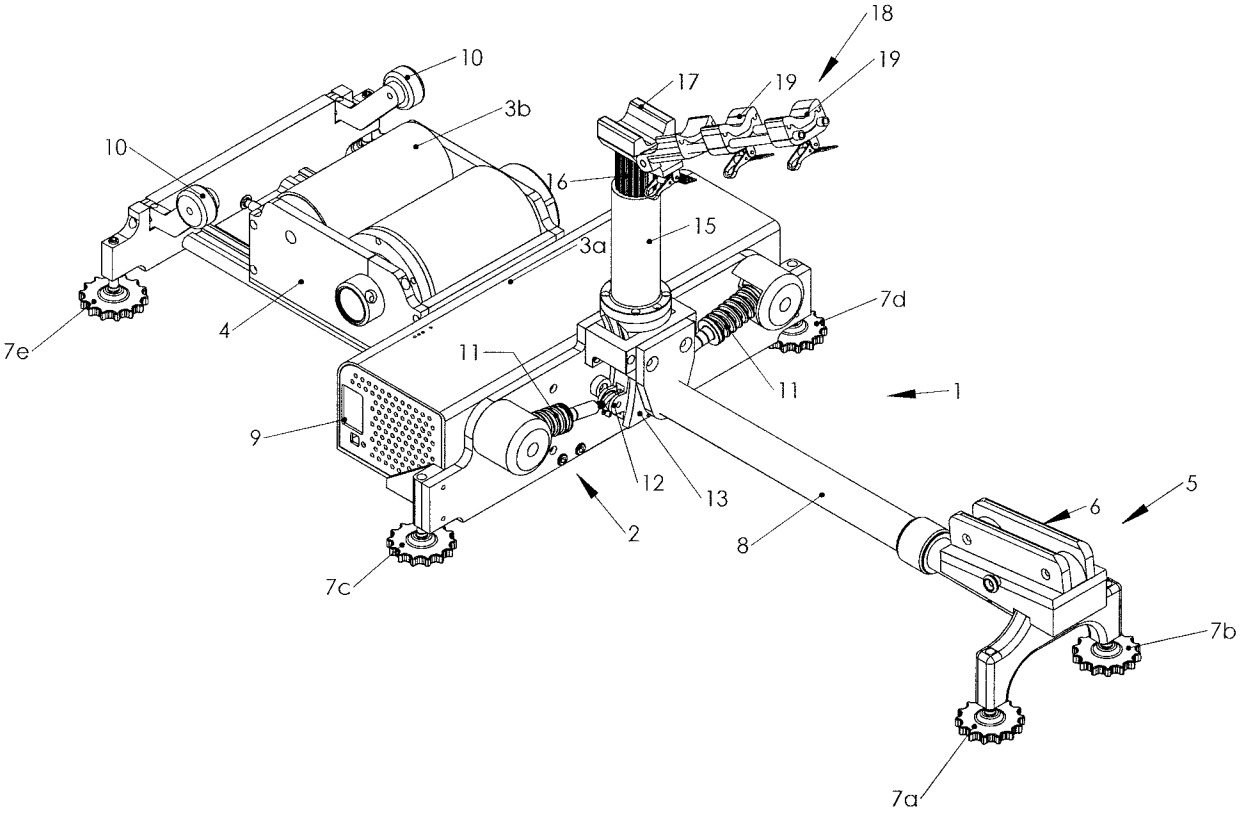
FIGS. 1 and 2 perspective views of a preferred embodiment of the bicycle trainer according to the present invention.
Figure 2:
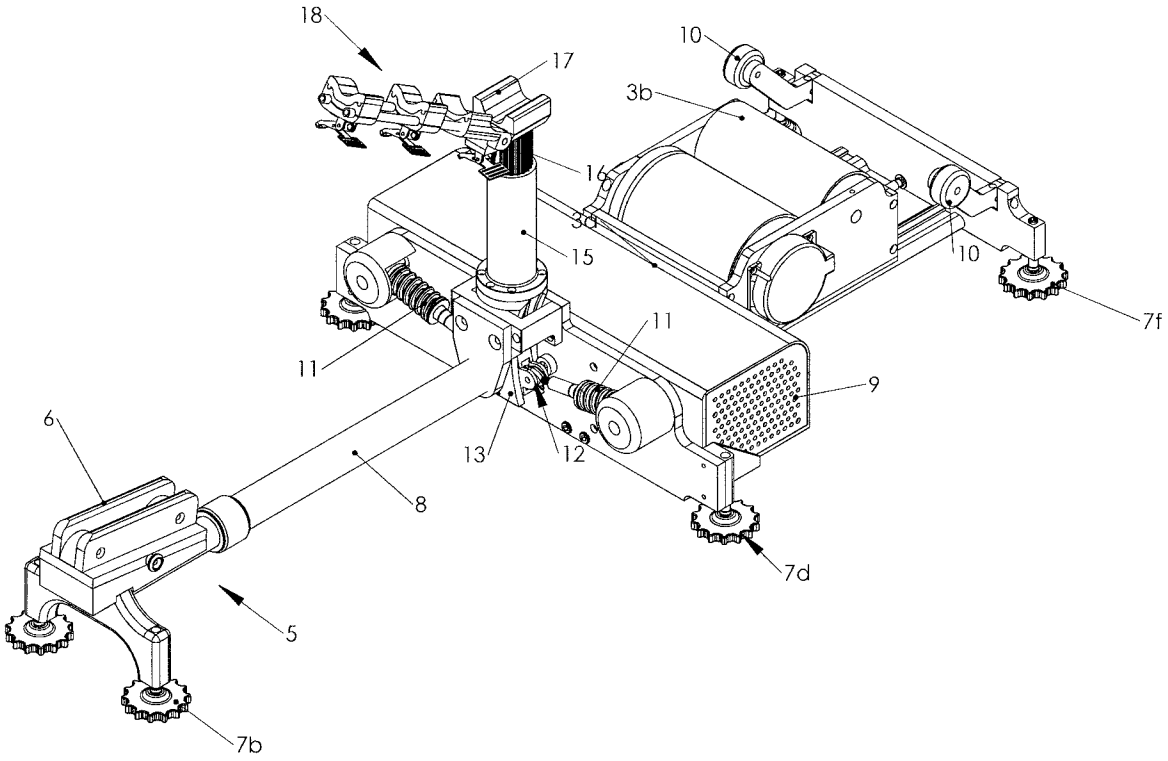
Figure 3:
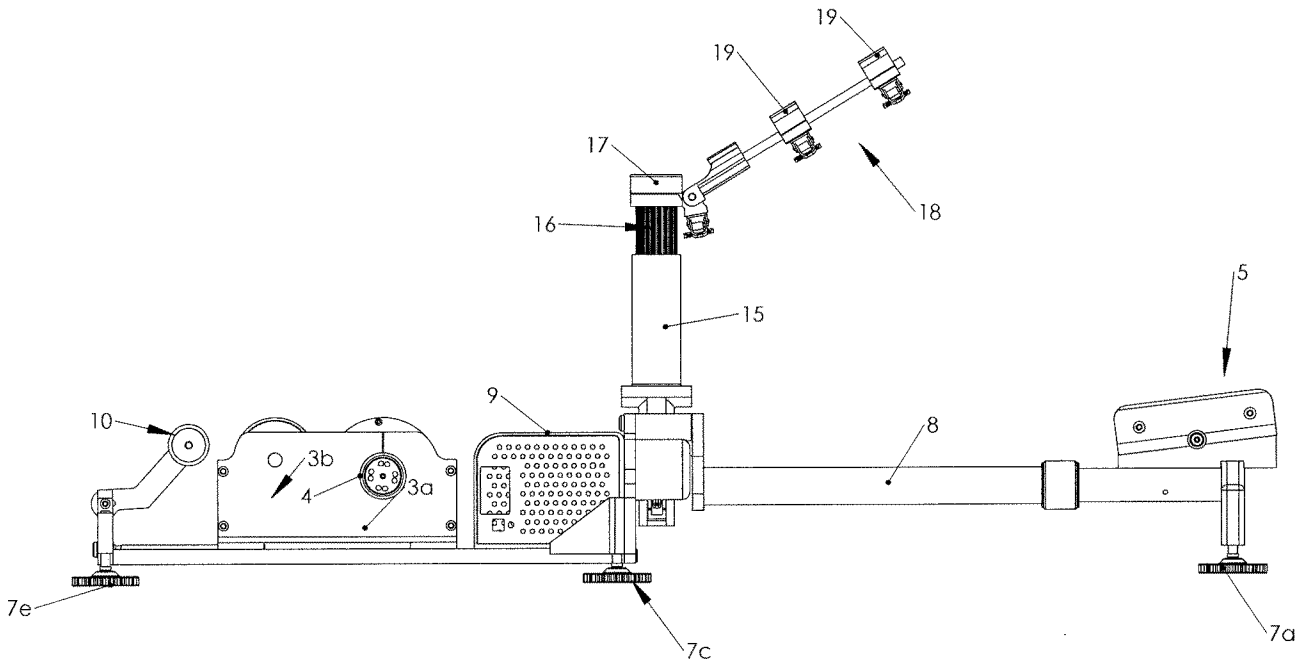
FIGS. 3 and 4 side views of the preferred embodiment of the bicycle trainer according to the present invention.
Figure 4:
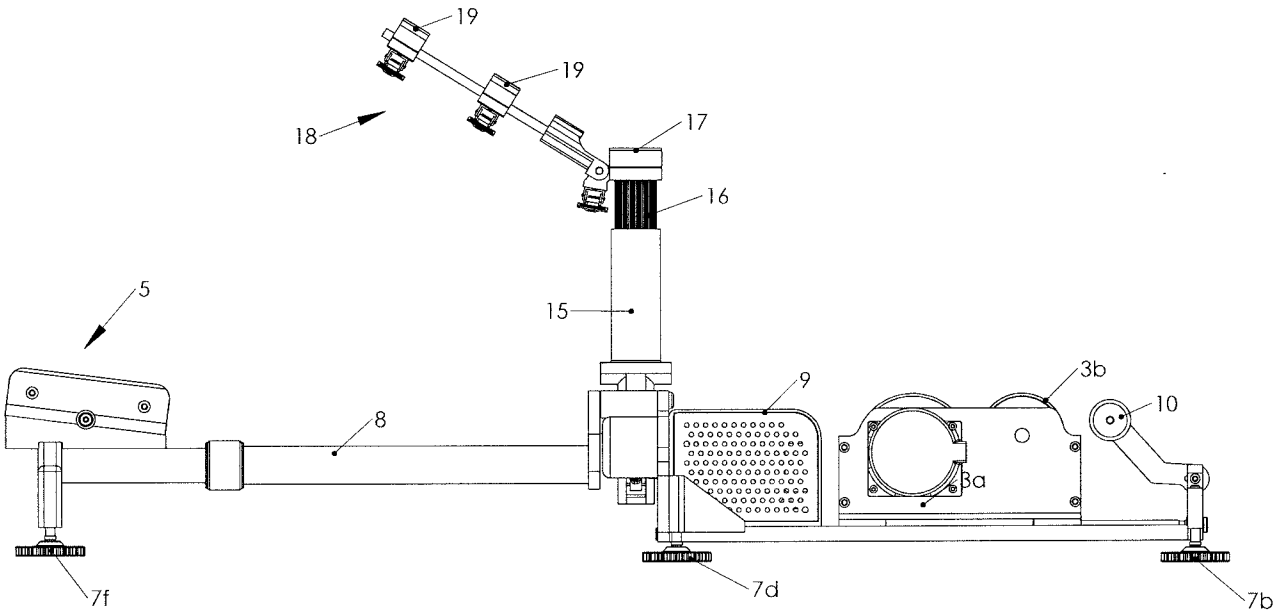
Figure 5:
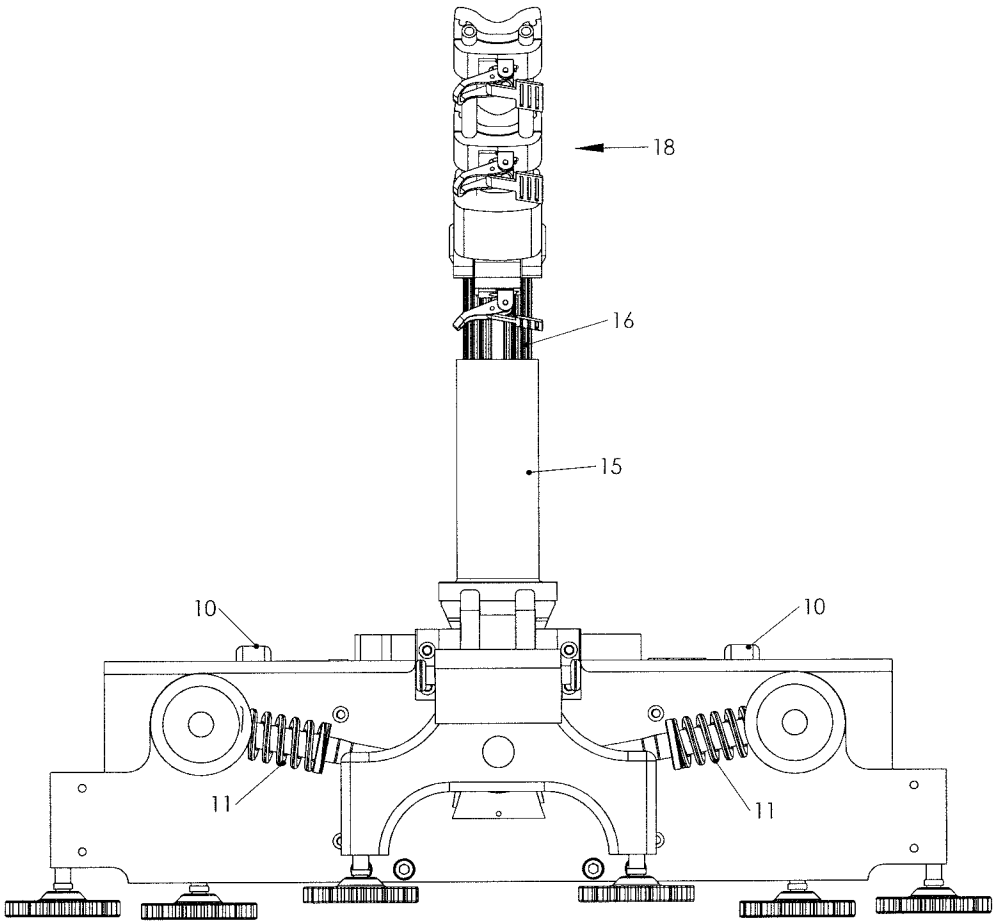
FIG. 5 a front view of the preferred embodiment of the bicycle trainer according to the present invention.
Figure 6:
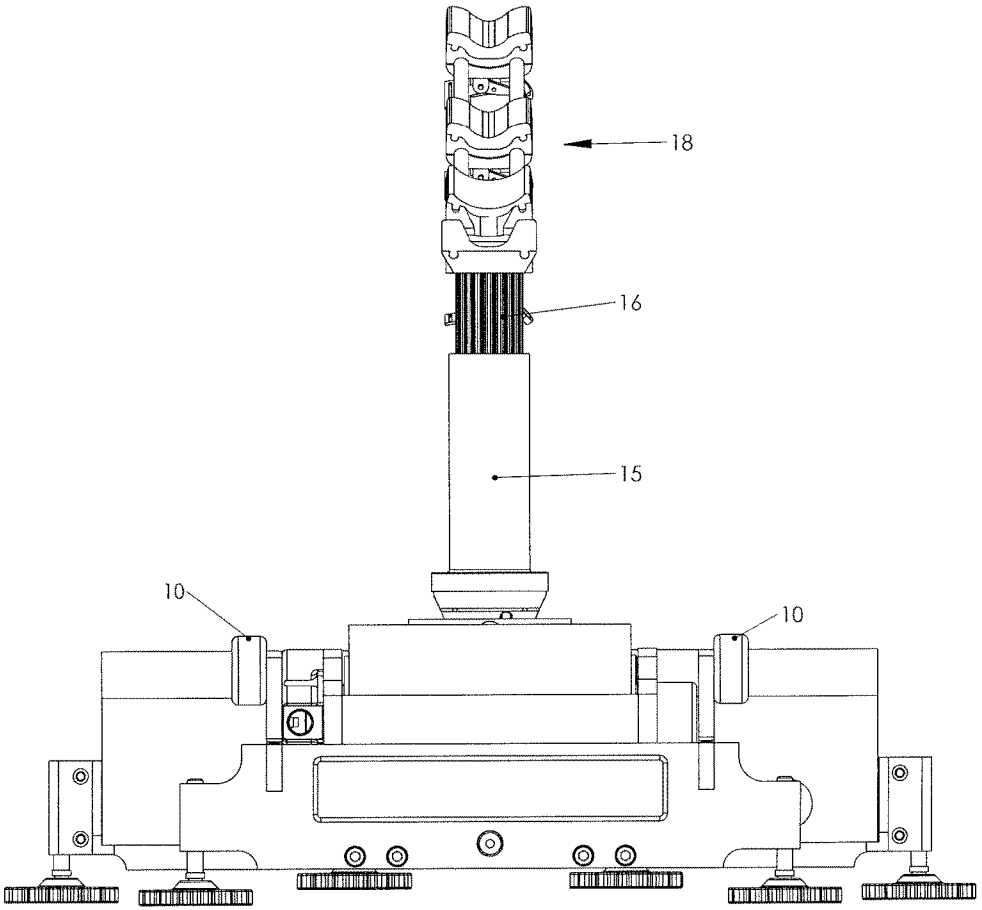
FIG. 6 a rear view of the preferred embodiment of the bicycle trainer according to the present invention.
Figure 7:
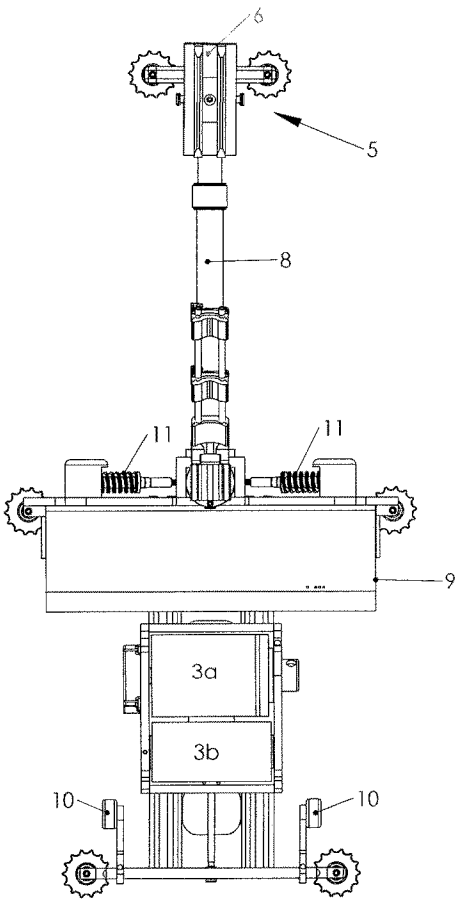
FIG. 7 a top view of the preferred embodiment of the bicycle trainer according to the present invention.
Figure 8:
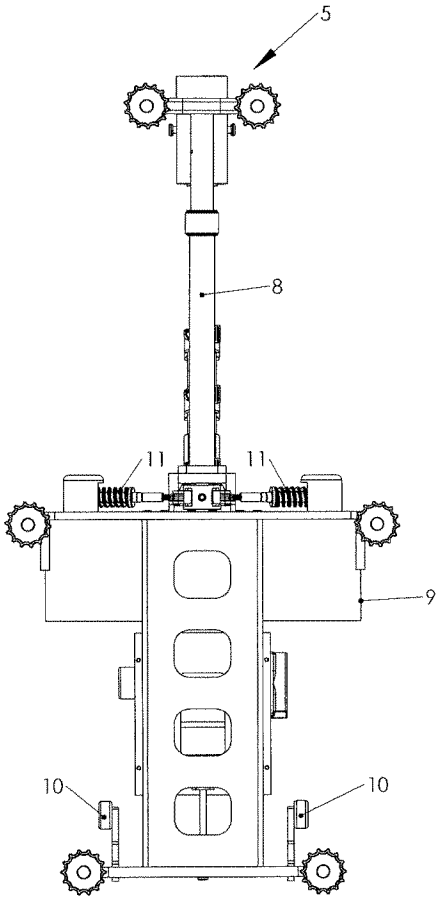
FIG. 8 a bottom view of the preferred embodiment of the bicycle trainer according to the present invention.

FIGS. 1 to 8 show a preferred embodiment of a bicycle trainer according to the present invention in perspective view (FIGS. 1 and 2), in a side view (FIGS. 3 and 4), in a front view (FIG. 5), in a back view (FIG. 6), in a top view (FIG. 7) and in a bottom view (FIG. 8). The bicycle trainer according to this preferred embodiment comprises a support 1 for supporting a bicycle (not shown) having a frame and a rear wheel attached to a rear axle. The support 1 comprises means 2 for biasing the bicycle into an upright orientation. The bicycle trainer further comprises a roller 3*a* for engaging with the rear wheel of the bicycle. When the bicycle is supported by the support 1, the roller is adapted to provide resistance against turning the rear wheel. The rear axle of the bicycle is not connected to the support 1.

The rear wheel of the bicycle rests, during use, on the roller 3*a* as well as on the second roller 3*b*. Because the roller 3*a* is connected to the support, the rear axle of the bicycle is arguably indirectly connected to the support via the rear wheel and the roller 3*a*. However, the present invention is understood in such a manner that the roller 3*a* is not part of the support 1 (even though connected thereto) and that the resting of the rear wheel on the roller 3*a* is not to be understood as a connection between the rear axle and the support. In particular, the rear axle of the bicycle is not mounted to the support in any way.

Rather, the rear wheel rests freely on, and is supported by, the first roller 3*a* and the second roller 3*b*. The front wheel of the bicycle rests on, and is supported by, a mounting portion 5 which preferably comprises means 6 for engaging the tire of the front wheel. The width of the slot for receiving the tire of the front wheel of the means 6 is preferably adjustable. Even though not required, the front wheel may in addition be fixed to the mounting portion 5 by means of an additional fixation element such as a rope or a strap. The distance between the mounting portion 5 for the front wheel and the two rollers 3*a* and 3*b* is preferably adjustable by the cylinder and piston 8. Thus, the bicycle trainer of the present invention can be adapted to any type and size of bicycle.

The mounting of the bicycle to the support 1 is achieved via the means 2 for biasing the bicycle into an upright orientation. The means 2 comprises a system of posts and rods. Inter alia, the means comprises a cylinder 15 and a piston 16 which can move up and down within the cylinder 15. Preferably, the outer surface of the piston has a grooved or riffled surface which engages with an accordingly grooved or riffled inner surface of the cylinder 15 in order to avoid rotation of the piston 16 within the cylinder 15. A means 17 for receiving and supporting a portion of the frame of the bicycle is preferably provided on top of the piston 16. Preferably, said means 17 is adapted for receiving and supporting the bottom bracket of the bicycle frame. In addition, the system of posts and rods comprises a bar 18 or the like for mounting the down tube of the bicycle to the means for biasing the bicycle into an upright orientation. In the preferred embodiment, the bar 18 comprises two rods and two adapters 19, which can slidably move along these two rods. These adapters 19 are adapted to engage with and to be mounted to the down tube of the bicycle frame. The adapters 19 may comprise any known releasable fastening system. Preferably, the adapters comprise straps for winding around the down tube of the bicycle frame which may then be tightened and fastened. In addition or alternatively, such or other releasable fastening system is provided to fix the bottom bracket of the bicycle frame to the means 17.

The bar 18 is preferably pivotably attached to the piston 16 in order to be adjustable to different orientations of the down tube of the bicycle frame. Once mounted, the bicycle frame, i.e. its bottom bracket, rests on the means 17 and the frame, preferably its down tube, is attached to the two adapters 19. Preferably, the bottom bracket is also attached to the means 17 to further stabilize the bicycle frame. However, the dimensions of the piston 16 and the cylinder 15 are preferably chosen in such a manner that the bicycle, once mounted, rests on the rollers 3*a* and 3*b* on the one hand and on the mounting portion 5 for the front wheel on the other hand. Yet, no substantial vertical upright force is transmitted from the means for biasing the bicycle into an upright orientation as long as the bicycle is oriented vertically. Moreover, since the piston 16 may move freely up and down within the cylinder 15, the entire bicycle can, once mounted, be lifted off the support.

The entire means for biasing the bicycle into an upright orientation is adapted to allow for a tilting movement of the bicycle. For this purpose, the cylinder 15 can be rotated or pivoted about a longitudinal axis (parallel to the piston and cylinder 8). However, pivoting the cylinder 15 compresses either of the two springs 11 which are connected via a mounting 12 to the cylinder 15, respectively. Preferably, the springs 11 have play in one direction. Accordingly, pivoting the cylinder 15 compresses one of the two springs 11, whereas the other of the two springs 11 is not expanded by force. The mounting portions 12 can preferably be moved upwards and downwards along the segment of a circle 13. Moving the mounting portions 12 along said circle segment does not change the compression of the springs 11, yet reduces or increases the lever arm acting from the cylinder 15 onto the springs 11. Preferably, the mounting portions 12 can be moved upwards and downwards by means of a motor and a spindle within the cylinder 15.

If a bicycle is mounted to the bicycle trainer and the user on the bicycle leans towards one side, the bicycle together with the cylinder 15 tilts away from the vertical and thereby compresses one of the springs 11. In response, this compressed spring 11 provides a torque biasing the bicycle back into an upright orientation. The amount of said torque can be adjusted by moving the mounting portions 12 upwards and downwards as discussed above. Thus, the user is provided with a certain amount of freedom to move on the bicycle, yet stabilized by the biasing torque. Preferably, a stop is provided which avoids a tilting movement of the cylinder 15 (and the bicycle, accordingly) beyond a predetermined critical angle versus the vertical.

Once mounted, the user may pedal on the bike in order to turn the rear wheel. The roller 3*a*, which is driven by a motor 4 being provided within the roller 3*a* actively provides resistance against turning the rear wheel and preferably also actively accelerates the rear wheel if needed. The second roller 3*b* can preferably freely rotate. The motor 4 within the roller 3*a* as well as the additional motor for adjusting the torque can be controlled by the controller unit 9. The controller unit or processor 9 can preferably be connected to a display and/or a computer in order to allow for displaying a certain training profile and/or for predefining specific parameters of a specific training unit.

The entire bicycle trainer rests on six foots 7*a* to 7*f* which are adjustable in height. Moreover, the bicycle trainer preferably comprises two additional rollers or wheels 10 which may be pivoted out of their resting position as shown in the Figures to allow for an easy movement of the bicycle trainer.

The invention claimed is:

1. A bicycle trainer comprising: a support for supporting a bicycle having a frame and a rear wheel attached to a rear axle, wherein the support is configured to directly receive a portion of the frame between the rear axle and a front axle of the bicycle, the support comprising a member being vertically oriented, pivotable, and coupled in between compressible resilient devices, wherein the member and the compressible resilient devices are configured to underlie the portion of the frame and bias the bicycle into an upright orientation, and a roller for engaging with the rear wheel of the bicycle, wherein, when the bicycle is supported by the support, the roller is configured to provide resistance against turning the rear wheel and the rear axle of the bicycle is not connected to the support.

2. The bicycle trainer according to claim 1, wherein the compressible resilient devices are configured to allow for a tilting movement of the bicycle.

3. The bicycle trainer according to claim 1, wherein the compressible resilient devices are configured to provide a torque biasing the bicycle into the upright orientation of the bicycle beyond a predetermined first critical angle relative to a vertical reference of the upright orientation.

4. The bicycle trainer according to claim 3, wherein the first critical angle is smaller than 1°.

5. The bicycle trainer according to claim 3, further comprising a stop configured to avoid a tilting movement of the bicycle beyond a predetermined second critical angle relative to the vertical reference of the upright orientation.

6. The bicycle trainer according to claim 5, wherein the second critical angle lies in a range between 2° and 6°.

7. The bicycle trainer according to claim 5, wherein the second critical angle lies in a range between 3° and 5°.

8. The bicycle trainer according to claim 3, wherein the first critical angle is smaller than 0.5°.

9. The bicycle trainer according to claim 1, wherein the support is configured to be directly connected to a down tube and/or a bottom bracket of the bicycle frame.

10. The bicycle trainer according to claim 1, wherein the compressible resilient devices comprise to independent springs.

11. The bicycle trainer according to claim 10, wherein the springs are configured to provide a torque biasing the bicycle into the upright orientation and wherein the amount of the torque can be adjusted manually and/or by means of a motor.

12. The bicycle trainer according to claim 11, wherein the torque can be adjusted by adjusting a lever arm.

13. The bicycle trainer according to claim 11, wherein the torque can be adjusted in a range between 5 Nm and 200 Nm.

14. The bicycle trainer according to claim 11, wherein the torque can be adjusted in a range between 15 Nm and 150 Nm.

15. The bicycle trainer according to claim 11, wherein the torque can be adjusted in a range between 25 Nm and 100 Nm.

16. The bicycle trainer according to claim 1, wherein, when the bicycle is supported by the support, the rear wheel of the bicycle is free to move in a lateral direction on the roller.

17. The bicycle trainer according to claim 1, wherein the support is also configured to allow for lifting the rear wheel off the roller when the bicycle is supported by the support.

18. The bicycle trainer according to claim 1, further comprising a motor configured to provide and adjust the resistance against turning the rear wheel.

19. The bicycle trainer according to claim 18, wherein the motor is provided within the roller.

20. The bicycle trainer according to claim 18, wherein the motor is configured else to accelerate the rear wheel.

* * * * *